US009623308B2

(12) United States Patent
Bourgeois

(10) Patent No.: US 9,623,308 B2
(45) Date of Patent: Apr. 18, 2017

(54) HITTING TRAINING DEVICE

(71) Applicant: Brad Bourgeois, Prairieville, LA (US)

(72) Inventor: Brad Bourgeois, Prairieville, LA (US)

( * ) Notice: Subject to any disclaimer, the term of this patent is extended or adjusted under 35 U.S.C. 154(b) by 0 days.

(21) Appl. No.: 14/826,986

(22) Filed: Aug. 14, 2015

(65) Prior Publication Data

US 2017/0043234 A1 Feb. 16, 2017

(51) Int. Cl.
*A63B 69/00* (2006.01)

(52) U.S. Cl.
CPC ..... *A63B 69/0002* (2013.01); *A63B 69/0091* (2013.01); *A63B 2069/0008* (2013.01)

(58) Field of Classification Search
CPC ..... A63B 69/0002; A63B 2069/0008; A63B 69/0084; A63B 69/0075; A63B 69/0091
USPC ..... 473/453, 451, 422, 467, 428, 417; D21/789
See application file for complete search history.

(56) References Cited

U.S. PATENT DOCUMENTS 2,985,452 A * 5/1961 Trippet ..... A63B 69/0002 473/453
3,937,464 A * 2/1976 Zalewski ..... A63B 69/0091 473/428
4,907,801 A 3/1990 Kopp
5,435,545 A 7/1995 Marotta
5,441,255 A * 8/1995 Verbick ..... A63B 69/0002 473/451
5,601,286 A 2/1997 Fierbaugh
5,605,326 A 2/1997 Spear, Jr.
5,711,726 A 1/1998 Powers
5,738,599 A 4/1998 Malwitz
5,788,589 A 8/1998 Koo et al.
6,458,037 B1 10/2002 Dixon, Jr.
6,688,994 B2 2/2004 Matulek et al.
6,786,841 B1 9/2004 Dixon
7,131,916 B2 11/2006 Griffin
7,217,202 B2 * 5/2007 Troxell ..... A63B 69/0002 473/451

(Continued)

OTHER PUBLICATIONS

Hurricane Category 4 http://shop.sklz.com/swing-trainers/hurricane-category-4/invt/js10000 Jul. 30, 2015.

(Continued)

*Primary Examiner* — Mitra Aryanpour
(74) *Attorney, Agent, or Firm* — John B. Edel; Edel Patents LLC

(57) ABSTRACT

Hitting training devices having a structural base, a vertical member extending upward from the structural base, a horizontal carriage having a horizontal carriage weight, a ball attached to the horizontal carriage, and a force balancing member arranged and configured to counteract the horizontal carriage weight are disclosed. The hitting training devices may be configured such that the horizontal carriage is attached to the vertical member, the horizontal carriage is configured to move horizontally with respect to the vertical member, the horizontal carriage is configured to move vertically with respect to the vertical member, the circumference of the ball is less than 13 inches, the horizontal carriage has a horizontal carriage range of horizontal motion of at least fourteen inches; and the horizontal carriage has a horizontal carriage range of vertical motion of at least sixteen inches.

13 Claims, 5 Drawing Sheets

(56) References Cited

U.S. PATENT DOCUMENTS

| | | | | |
|---|---|---|---|---|
| 7,226,373 | B2 | 6/2007 | Arenas | |
| 7,465,243 | B2 * | 12/2008 | Cramer | A63B 69/0002 473/417 |
| 7,517,290 | B1 * | 4/2009 | Springer | A63B 69/0002 473/422 |
| 7,601,081 | B1 * | 10/2009 | Larkey | A63B 69/0002 473/422 |
| 7,641,573 | B2 * | 1/2010 | Cech | A63B 69/0002 473/417 |
| 8,033,934 | B1 | 10/2011 | Clancy | |
| 8,556,753 | B1 * | 10/2013 | Dixon, Jr. | A63B 69/0002 473/417 |
| 8,585,516 | B1 | 11/2013 | Buono et al. | |
| 8,657,708 | B2 * | 2/2014 | Pijanowski | A63B 69/0002 473/422 |
| 8,932,155 | B2 * | 1/2015 | Moore | A63B 63/083 473/422 |
| 9,339,709 | B2 * | 5/2016 | Lagier | A63B 69/0002 473/453 |
| 2006/0003858 | A1 | 1/2006 | Alibozek | |
| 2013/0324329 | A1 | 12/2013 | Ramcharan | |

OTHER PUBLICATIONS

Hit-A-Way PTS http://shop.sklz.com/swing-trainers/hit-a-wayr-pts/invt/hw01pts Jul. 30, 2015.

Hit-A-Way http://shop.sklz.com/swing-trainers/hit-a-wayr-baseball/invt/sjs0110th04 Jul. 30, 2015.

Target Swing Trainer http://shop.sklz.com/swing-trainers/target-swing-trainer/invt/sjs09 Jul. 30, 2015.

RBI Vortex http://www.rbivortex.com/ Jul. 30, 2015.

Swingaway http://www.swingaway.com/ Jul. 30, 2015.

Slugmaster http://www.slugmaster.com/ Jul. 30, 2015.

Batter Up http://www.sportsauthority.com/Trend-Sports-Batter-Up-Batting-Trainer/product.jsp?productId=4192579 Jul. 30, 2015.

Pro Power Drive Swing Trainer Tee http://www.batterupind.com/baseball-hitting-tee-pro-power-drive-swing-trainer-tee/ Jul. 30, 2015.

Rotor Twin Hitting Trainer http://www.athleticstuff.com/rotor-twin-hitting-trainer/bsroto/product Jul. 30, 2015.

Solo Hitter SLT3000 Hitting Station https://www.solohitter.com/SLT3000_Tournament_Model_p/slt3000.htm Jul. 30, 2015.

Zepp http://www.zepp.com/baseball/ Jul. 30, 2015.

* cited by examiner

HITTING TRAINING DEVICE

Hitting training devices described herein may be used in batting practice for the game of baseball. Certain hitting training devices disclosed herein have particular utility in the swing training or hitting training of a batter that may be focusing on pitches located in particular areas of the strike zone. Certain embodiments of the device may have particular utility relating to the measurement of the effect of a bat hitting a ball.

DETAILED DESCRIPTION

EXAMPLE 1

Figure 1:
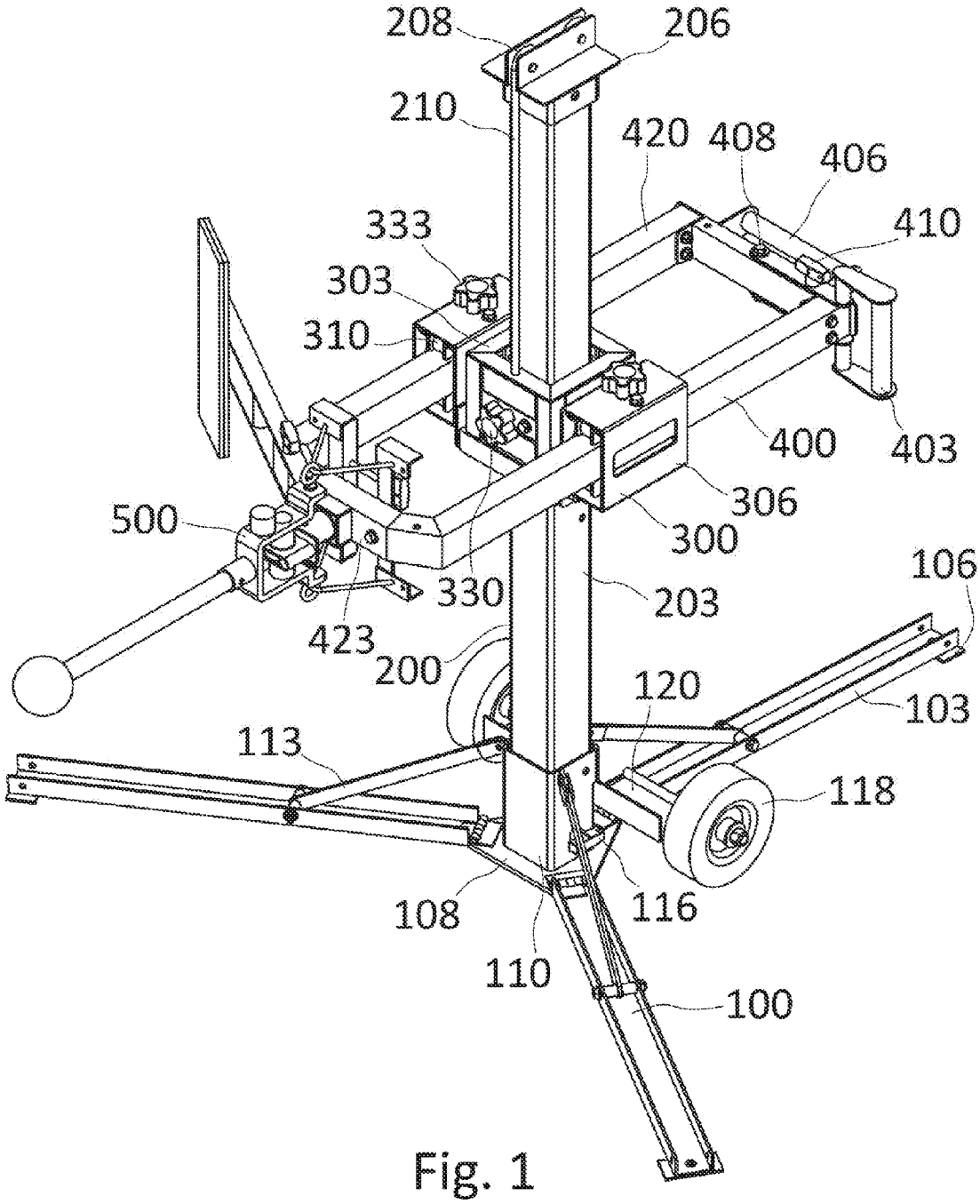
FIG. 1 shows a perspective view of a hitting training device.
Figure 2:
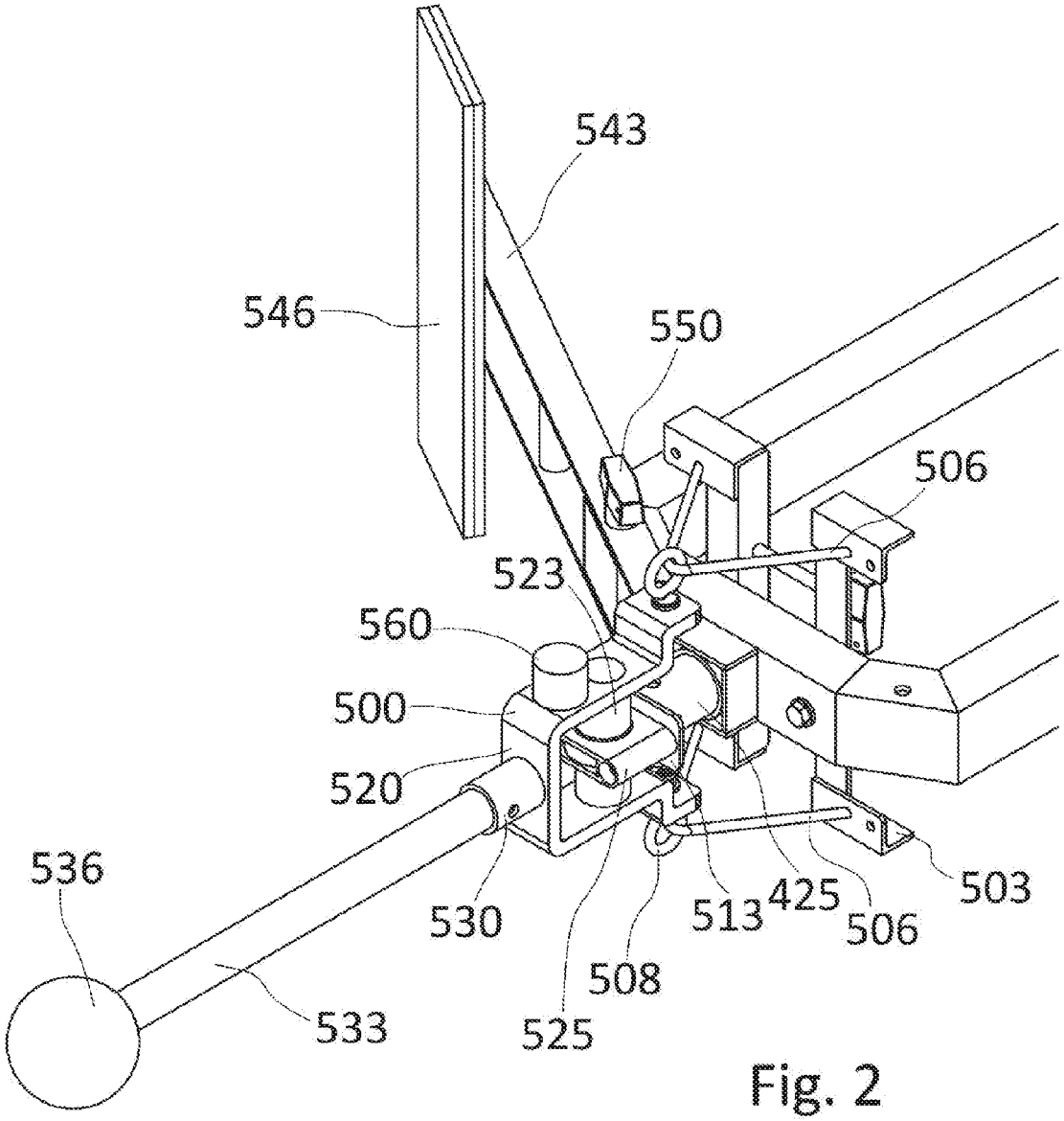
FIG. 2 shows perspective view of a portion of a hitting training device.
Figure 3:
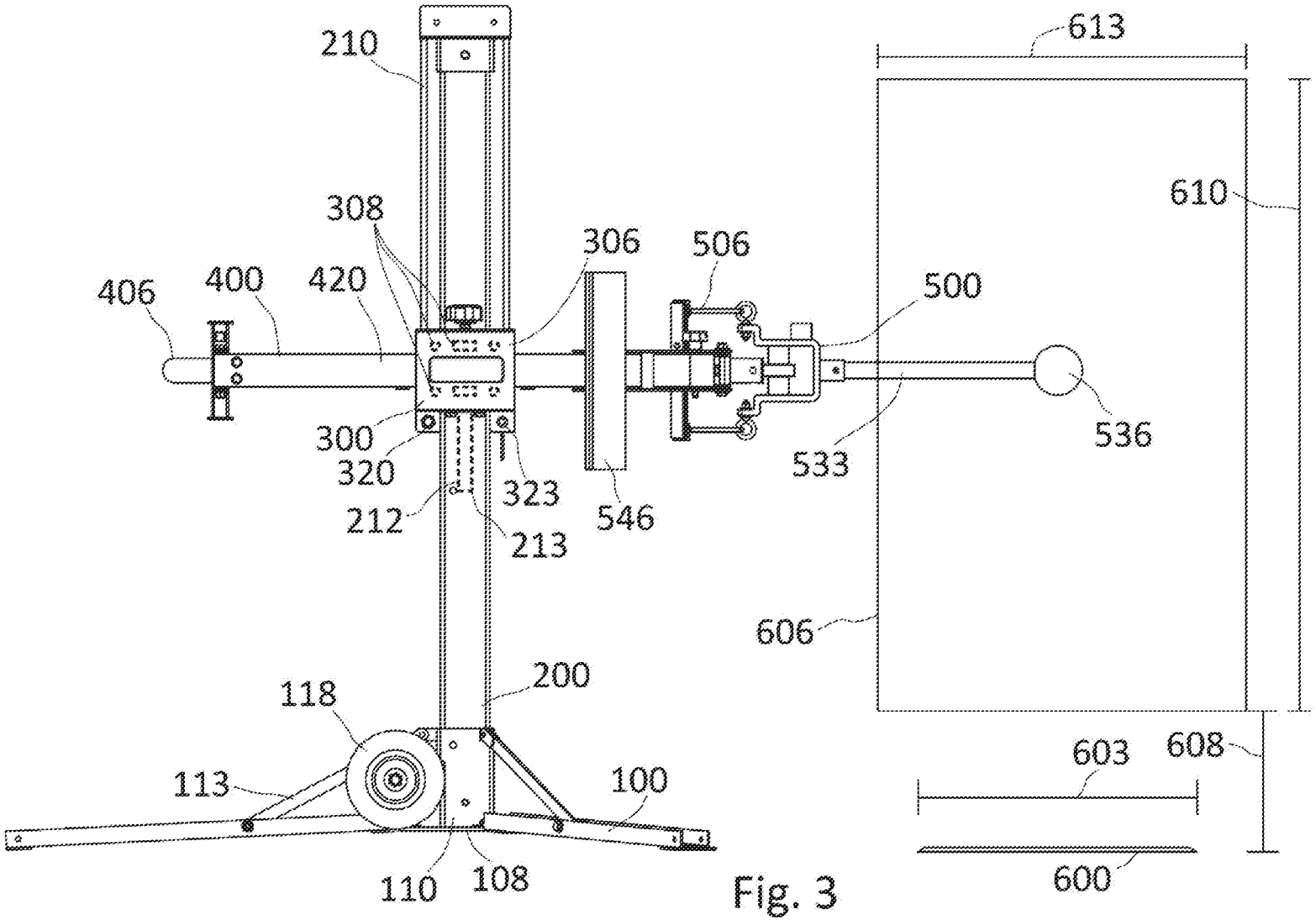
FIG. 3 shows an elevation view of a hitting training device from the perspective of a pitcher.
Figure 4:
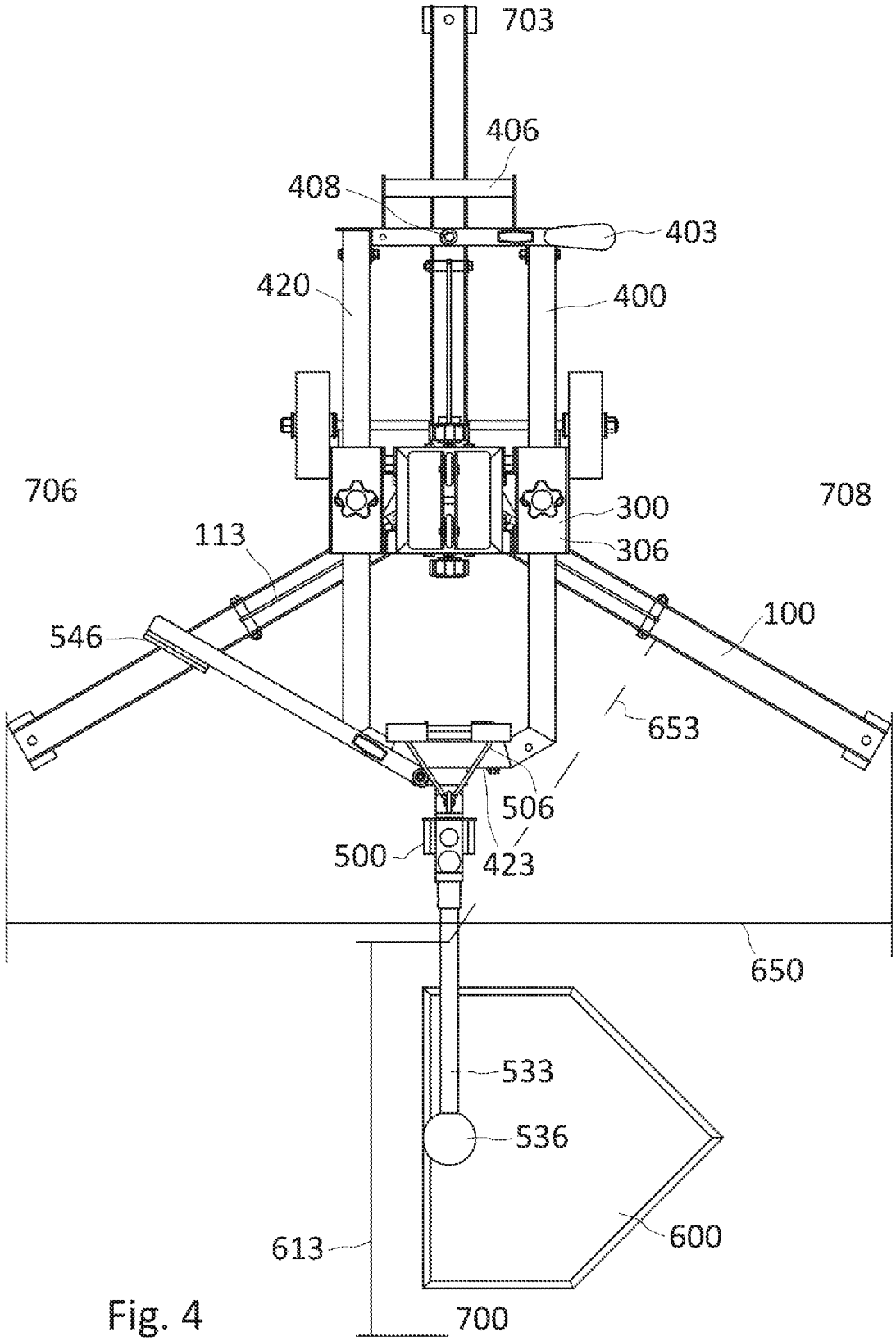
FIG. 4 shows a plan view of a hitting training device.
Figure 5:
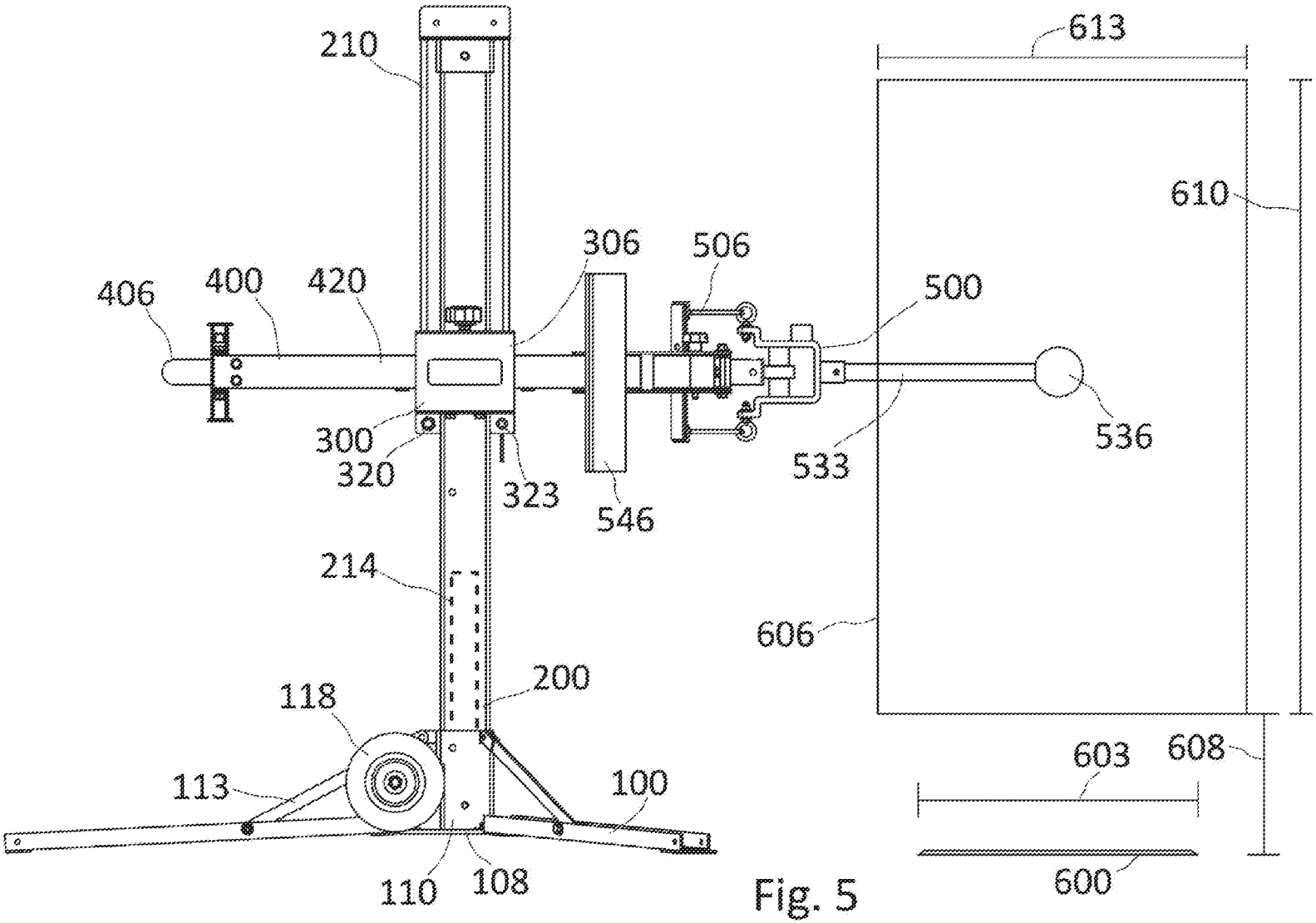
FIG. 5 shows an elevation view of a hitting training device from the perspective of a pitcher.

Referring now to FIGS. 1-5 of the drawings, hitting training devices herein may include a Base structure 100, a Vertical support system 200, a Vertical carriage system 300, a Horizontal carriage system 400 and a Hitting structure 500. Base structure 100 may for example comprise Legs 103, Feet 106, Base plate 108, First sliding collar 110, Leg braces 113, Base structure locking pin 116, Wheels 118, and Wheel support structures 120. Vertical support system 200 may, for example, comprise a Central post 203, a Post top 206, Pulleys 208, Carriage support lines 210 and a Carriage counterbalance weight 213. Carriage counterbalance weight 213, as depicted in FIG. 3, may be replaced with a Spring 214, as depicted in FIG. 5. Both Carriage counterbalance weight 213 and Spring 214 may be characterized as a Force balancing member 212. Vertical carriage system 300 may, for example, comprise a Central frame member 303, with Horizontal bar guides 306 attached to the Central frame member 303, and a Clamping screw 330. Central frame member 303 may have multiple Vertical rollers 308, Storage pivot pin 320 and a Storage locking pin 323. Horizontal bar guides 306 may have multiple Horizontal rollers 310 and a pair of Clamping screws 333. Horizontal carriage system 400 may, for example, comprise Horizontal bars 420, Horizontal carriage forward frame member 423, Horizontal carriage hitting structure collar 425, Horizontal carriage rear frame member 426, Horizontal carriage rear adjustable handle 403, Horizontal carriage rear central handle 406, Horizontal carriage rear handle pivot bolt 408, and Horizontal carriage rear pivoting handle locking pin 410. Hitting structure 500 may, for example, comprise Return frame 503, Elastic return line 506, Eyelets 508, Hitting structure mounting plate and post 513, Bracket 520, Bracket pivot shaft 523, Bracket pivot shaft bearing 525, Sleeve 530, Ball support shaft 533, Ball 536, Impact pad support arm 543, Impact pad 546, Impact pad locking pin 550 and Hit sensor 560. Home plate 600, Home plate width 603, Ball travel area 606, Ball travel bottom height 608, Ball travel height range 610, Ball travel width range 613, Base width 650 and Base separation distance 653 are also depicted in the figures. Referring in particular to FIG. 4 of the drawings, certain components and relationships may be referred to by their general orientation on the hitting training device. That notation of general orientation may include a Batter's side 700 opposite a Coach's side 703 and a Pitcher's side 706 opposite a Catcher's side 708.

Base structure 100 may act as a support for the hitting training device and may include Legs 103 which may be collapsible. In certain embodiments, Legs 103 may have holes configured such that Legs 103 may be staked into the ground providing further structural support. Legs 103 may contact the ground with Feet 106 and Base plate 108 and be supported by Leg braces 113 which connect Legs 103 to First sliding collar 110. First sliding collar 110 may slide up and down Vertical support system 200 allowing Legs 103 to collapse against Vertical support system 200 allowing the device to assume a compact configuration and allowing for easy transport of the hitting training device. When collapsed in this manner, Wheels 118 are exposed allowing easy transport. Base structure locking pin 116, may be used to secure First sliding collar 110 in place along Vertical support system 200 in either the collapsed configuration or the configuration in which Base structure 100 is fully extended. Wheels 118 may be attached to either Base plate 108 or Central post 203 by way of Wheel support structures 120 and may be used to transport the hitting training device. Legs 103 may be pivotally attached to Base plate 108 and Vertical support system 200 may directly attached to Base plate 108.

Vertical support system 200 contains a Central post 203 which may include Post top 206 having Pulleys 208. Pulleys 208 support Carriage support lines 210 which, in turn, support Carriage counterbalance weight 213 and Vertical carriage system 300. Carriage support lines 210 may be wire rope and Carriage counterbalance weight 213 may be concealed within Central post 203. The combined weight of Vertical carriage system 300, Horizontal carriage system 400 and Hitting structure 500 may be roughly equivalent to the weight of Carriage counterbalance weight 213 such that Horizontal carriage system 400 may move freely either horizontally or vertically with the application of force that is relatively small compared to the combined weight of Vertical carriage system 300, Horizontal carriage system 400 and Hitting structure 500. Central post 203 may include markings to indicate the height of Ball 536.

Vertical carriage system 300 may be configured to slide freely up and down Vertical support system 200 and the weight of Vertical carriage system 300 may be supported in part by a spring or a counterbalance weight such that Vertical carriage system 300 may be raised by lifting with a force less than what would be required to lift the weight of Vertical carriage system 300 and elements supported by Vertical carriage system 300 without the spring or counterbalance weight. The vertical travel of Vertical carriage system 300 allows Ball 536 to travel vertically through its range of motion which may include the full height of a strike zone in the game of baseball. Ball 536 may be sized, arranged and configured as a baseball. Central frame member 303 is the portion of Vertical carriage system 300 surrounding Vertical support system 200. Eight total Vertical rollers 308 may be positioned within Central frame member 303 such that it rolls freely and smoothly along Vertical support system 200. In certain embodiments two Vertical rollers 308 may be positioned one above another on each of the Batter's side 700, the Coach's side 703, the Pitcher's side 706 and the Catcher's side 708 with all eight Vertical rollers 308 being in contact with Vertical support system 200.

As shown in FIG. 3, Storage pivot pin 320 and Storage locking pin 323 connect Central frame member 303 (not shown in FIG. 3) to Horizontal bar guides 306. Horizontal carriage system 400, Hitting structure 500, and Horizontal bar guides 306 may pivot around Storage pivot pin 320 such that Hitting structure 500 is lowered closer to the bottom of Vertical support system 200 and Horizontal carriage rear central handle 406 is closer to the top of Vertical support system 200. In this storage position, the hitting training device may be more easily stored and more easily transported. When configured for transport or storage, Hitting structure 500 may be removed and Horizontal carriage rear central handle 406 may be used to push or pull the hitting training device around on Wheels 118. Impact pad support arm 543 and Impact pad 546 may also be reconfigured to shrink the total space required for storage of the hitting training device. The transport of the hitting training device, may for example take place with both Horizontal carriage system 400 and Hitting structure 500 in the storage position and with First sliding collar 110 collapsed such that Legs 103 are collapsed against Vertical support system 200. The placement of Horizontal carriage system 400 and Hitting structure 500 in the storage position may be accomplished by pulling Storage locking pin 323 and rotating Horizontal carriage system 400 and Hitting structure 500. When the hitting training device is ready for use the Horizontal carriage system 400 and Hitting structure 500 can be returned to an orientation in which Horizontal bars 420 are in the horizontal orientation and Storage locking pin 323 may be returned into the appropriate hole locking Horizontal carriage system 400 and Hitting structure 500 into the position shown in FIGS. 1-4.

Vertical carriage system 300 may be secured in place with respect to Vertical support system 200 by Clamping screw 330 which may take the form of a knob on a threaded bolt with a rubber stopper on the end opposite the knob. Horizontal bar guides 306 are configured to allow the passage of Horizontal bars 420 of Horizontal carriage system 400 through Horizontal bar guides 306 which may include Horizontal rollers 310 which sandwich Horizontal carriage system 400 such that Horizontal carriage system 400 may pass through Horizontal bar guides 306 smoothly. In certain embodiments Horizontal bar guides 306 may include an opening in the side as depicted in FIGS. 1 and 2 through which markings such as "inside," "middle in," "middle," "middle out," and "outside" may be displayed on Horizontal bars 420. Such marking may provide further guidance as to the location of the ball relative to Home plate 600. Horizontal bar guides 306 may further have an indicator marking arranged to line up with the markings indicating the position of Ball 536. In certain embodiments, Horizontal bars 420 on both the Pitcher's side 706 and the Catcher's side 708 are each sandwiched by a pair of Horizontal rollers 310 on top and a pair of Horizontal rollers 310 on bottom such that a total of eight rollers guide the Horizontal carriage system 400 along the path of its horizontal motion. Clamping screws 333 may act to secure Vertical carriage system 300 relative to Horizontal carriage system 400. Clamping screws 333 may be configured similarly to Clamping screw 330. The horizontal motion of Horizontal carriage system 400 allows Ball 536 to travel horizontally through its range of motion which may include the full width of a strike zone in the game of baseball. Horizontal carriage system 400 may be operated to manipulate the position of Ball 536 either horizontally or vertically by manually moving Horizontal carriage system 400 with either Horizontal carriage rear adjustable handle 403 or Horizontal carriage rear central handle 406. Horizontal carriage rear adjustable handle 403 may be operated from either side of Horizontal carriage system 400 because Horizontal carriage rear adjustable handle 403 may be relocated to either side of Horizontal carriage system 400 by pivoting Horizontal carriage rear adjustable handle 403 around Horizontal carriage rear handle pivot bolt 408 and locking Horizontal carriage rear adjustable handle 403 into place by securing Horizontal carriage rear adjustable handle 403 with Horizontal carriage rear pivoting handle locking pin 410 such that the Horizontal carriage rear adjustable handle 403 is fixed relative to Horizontal carriage rear frame member 426. The hitting training device may be positioned and configured to accommodate both left-handed and right-handed batters by positioning the hitting training device on the side of Home plate 600 opposite the batter and both positioning Horizontal carriage rear adjustable handle 403 on the Catcher's side 708 of the hitting training device and positioning Impact pad 546 on the Pitcher's side 706 of the hitting training device.

Horizontal carriage hitting structure collar 425 on Horizontal carriage forward frame member 423 serves as the point of attachment for Hitting structure 500 which includes Return frame 503, Elastic return line 506, Eyelets 508, Hitting structure mounting plate and post 513, Bracket 520, Bracket pivot shaft 523, Bracket pivot shaft bearing 525, Sleeve 530, Ball support shaft 533, Ball 536, Impact pad support arm 543, Impact pad 546, Impact pad locking pin 550 and Hit sensor 560. Bracket pivot shaft 523 pivots within Bracket pivot shaft bearing 525. Bracket pivot shaft bearing 525 may be a spherical bearing and may pivot up to 25 degrees up and down in addition to pivoting along the normal pivot path that would typically be associated with a non-spherical bearing. Ball 536 may be struck by a baseball or softball bat such that both Ball 536 and Ball support shaft 533 along with Bracket 520 pivot around Bracket pivot shaft 523 and such that Ball 536 impacts Impact pad 546. Impact pad 546 is configured to absorb energy from an impact from Ball 536. When Ball 536 departs from the position shown in FIG. 2, Elastic return line 506, which is looped through Eyelets 508, stretches providing the tension necessary to quickly return Ball 536 back to its initial position, the position shown in FIG. 2. Ball 536 and Ball support shaft 533 may be replaced by removing Ball 536 and Ball support shaft 533 from Sleeve 530 which may have a locking pin or other securing device to hold Ball 536 and Ball support shaft 533 in place during the use of the hitting training device. Ball 536 and Ball support shaft 533 may be replaced with various Ball 536 and Ball support shaft 533 combinations that include baseball sized balls, softball sized balls or other ball sizes including balls smaller than baseballs. Hitting structure mounting plate and post 513 may be configured such that the post of Hitting structure mounting plate and post 513 may slide into Horizontal carriage hitting structure collar 425 and may be locked into position with a locking pin thus providing a secure connection between Horizontal carriage system 400 and Hitting structure 500. Impact pad support arm 543 may be positioned on either side of the hitting training device such that Impact pad 546 faces Ball 536 allowing the hitting training device to be used by both right-handed batters and left-handed batters. Impact pad locking pin 550 fixes Impact pad support arm 543 and Impact pad 546 in place in either position. Hit sensor 560 may be configured to measure details associated with impacts or hits on Ball 536. For example, Hit sensor 560 may provide details regarding the hit such as estimating the initial velocity of the ball after it leaves the bat, the direction of the ball as it leaves the bat or it may estimate ball exit velocity or direction of travel for a hypothetical ball that was pitched by a pitcher and met with a similar impact from the bat. Hit sensor 560 may incorporate one or more accelerometers or other components capable of identifying the characteristics of how the bat strikes the ball.

Pins described herein as locking pins may take the form of quick release pins, clevis pins with cotter pins, hitch pins, safety pins or other fasteners suitable for the application including various types of screws and bolts. For example a set screw, which may also include a handle, may be used as an alternative for one or more of the locking pins.

The hitting training device is generally configured such that Ball 536 may be positioned above Home plate 600 and such that Ball travel area 606, representing the possible range of travel of Ball 536 when Horizontal carriage system 400 is moved through its full vertical and horizontal range of motion, is above Home plate 600. Ball travel area 606 may have a Ball travel width range 613 that fully encompasses Home plate width 603. A Ball travel bottom height 608 representing the bottom of the range of motion of Ball travel area 606 may be positioned below a typical strike zone. Ball travel height range 610, which represents the range of height that may be traveled by Ball 536, may be tall enough to completely encompass the height of a strike zone for a 6 foot tall baseball player. Base width 650 represents the width of Base structure 100 at its widest point as measured perpendicular to Ball support shaft 533. Base separation distance 653 represents the horizontal separation of the nearest portion of Base structure 100 from Ball travel area 606. In certain embodiments Base separation distance 653 may be greater than 12 inches and in certain other embodiments Base separation distance 653 may be greater than 18 inches.

The hitting training device may be predominately constructed of steel, aluminum or other suitable resilient materials.

Referring now particularly to FIGS. 3 and 4 of the drawings, the hitting training device may be characterized by any of the individual characteristics indicated in Tables 1 and 2, or by any number of characteristics associated with the individual example sets. The embodiment depicted in FIGS. 1-4 is an example of an embodiment that may be characterized as having features associated with example sets 1A-1P. Table 1 below describes 16 groups of characteristics that may be associated with a hitting training device. For example, Example set 1A describes characteristics of a group of embodiments, of which the hitting training device of FIGS. 1-4 is a member, in which the Ball travel area is greater than 360 $in^2$, the Ball travel bottom height is less than 22 inches, the Ball travel height range is greater than 24 inches and the Ball travel width range is greater than 15 inches.

TABLE 1

| Example Set | Ball travel area | Ball travel bottom height | Ball travel height range | Ball travel width range |
|---|---|---|---|---|
| 1A | >360 $in^2$ | <22 in. | >24 in. | >15 in. |
| 1B | >500 $in^2$ | <22 in. | >24 in. | >15 in. |
| 1C | >360 $in^2$ | <18 in. | >24 in. | >15 in. |
| 1D | >500 $in^2$ | <18 in. | >24 in. | >15 in. |
| 1E | >360 $in^2$ | <22 in. | >30 in. | >15 in. |
| 1F | >500 $in^2$ | <22 in. | >30 in. | >15 in. |
| 1G | >360 $in^2$ | <18 in. | >30 in. | >15 in. |
| 1H | >500 $in^2$ | <18 in. | >30 in. | >15 in. |
| 1I | >360 $in^2$ | <22 in. | >24 in. | >19 in. |
| 1J | >500 $in^2$ | <22 in. | >24 in. | >19 in. |
| 1K | >360 $in^2$ | <18 in. | >24 in. | >19 in. |

TABLE 1-continued

| Example Set | Ball travel area | Ball travel bottom height | Ball travel height range | Ball travel width range |
|---|---|---|---|---|
| 1L | >500 $in^2$ | <18 in. | >24 in. | >19 in. |
| 1M | >360 $in^2$ | <22 in. | >30 in. | >19 in. |
| 1N | >500 $in^2$ | <22 in. | >30 in. | >19 in. |
| 1O | >360 $in^2$ | <18 in. | >30 in. | >19 in. |
| 1P | >500 $in^2$ | <18 in. | >30 in. | >19 in. |

The smallest amount of force capable of moving Ball 536 through its full vertical and horizontal range of motion, namely both directions horizontally and up and down vertically in a plane such as depicted as Ball travel area 606 in FIG. 3, is referred to herein as the "Ball displacement force." Table 2 below describes eight example sets of additional characteristics. The Ball displacement force may, for example, be applied at Horizontal carriage rear adjustable handle 403. The embodiment depicted in FIGS. 1-4 is an example of an embodiment that may be characterized as having features associated with example sets 2A-2H. Table 2 below describes eight groups of characteristics that may be associated with a hitting training device. For example, Example set 2A describes characteristics of a group of embodiments, of which the hitting training device of FIGS. 1-4 is a member, in which the base width is greater than 35 in, the Base separation distance is less than 8 inches and the Ball displacement force is greater than 1 pound force. Any member of example set 2A-2H may also have one or more characteristics associated with example sets 1A-1P.

TABLE 2

| Example Set | Base Width | Base separation distance | Ball displacement force |
|---|---|---|---|
| 2A | >35 in. | >8 in. | >1 $lb_f$ |
| 2B | >46 in. | >8 in. | >1 $lb_f$ |
| 2C | >35 in. | >14 in. | >1 $lb_f$ |
| 2D | >46 in. | >14 in. | >1 $lb_f$ |
| 2E | >35 in. | >8 in. | <25 $lb_f$ |
| 2F | >46 in. | >8 in. | <25 $lb_f$ |
| 2G | >35 in. | >14 in. | <25 $lb_f$ |
| 2H | >46 in. | >14 in. | <25 $lb_f$ |

Hitting training apparatus described herein may, for example, comprise a structural base; a vertical member extending upward from the structural base; a horizontal carriage having a horizontal carriage weight; a ball attached to the horizontal carriage; and a force balancing member arranged and configured to counteract the horizontal carriage weight; wherein the horizontal carriage is attached to the vertical member; wherein the horizontal carriage is configured to move horizontally with respect to the vertical member; wherein the horizontal carriage is configured to move vertically with respect to the vertical member; wherein the circumference of the ball is less than 13 inches; wherein the horizontal carriage has a horizontal carriage range of horizontal motion of at least fourteen inches; and wherein the horizontal carriage has a horizontal carriage range of vertical motion of at least sixteen inches. In a related example, the ball may be pivotally attached to the horizontal carriage. In a further related example, the force necessary to raise the horizontal carriage may be less than the horizontal carriage weight. In a further related example, the ball may be located in a first position and the ball may be arranged and configured to return to the first position after being struck by a bat.

Hitting training apparatus described herein may, for example, comprise a structural base; a vertical member extending upward from the structural base; a horizontal carriage having a horizontal carriage weight; a ball flexibly attached to the horizontal carriage by an arm; a force balancing member arranged and configured to counteract the horizontal carriage weight; an intermediate carriage connecting the horizontal carriage to the vertical member; and a handle attached to the horizontal carriage; wherein the intermediate carriage is arranged and configured to travel vertically along the vertical member and wherein the horizontal carriage is arranged and configured to travel horizontally along the intermediate carriage. In a related example, the arm may be at least 10 inches long. In a further related example, the arm may have an arm length, the ball may be separated from the handle by a ball-handle separation distance and the ball-handle separation distance may be at least twice the arm length. In a further related example, the hitting training apparatus may have a sensor configured to identify characteristics of a bat striking the ball. In a further related example, the structural base may be at least 26 inches wide. In a related example, the ball may be pivotally attached to the horizontal carriage. In a further related example, the force balancing member may be a spring. In a further related example, the force balancing member may be a counterbalance weight. In a still further related example, the hitting training apparatus may further comprise an impact pad configured to absorb energy from impact by the ball. In a related example, the hitting training apparatus may further comprise wheels.

The above-described embodiments have a number of independently useful individual features that have particular utility when used in combination with one another including combinations of features from embodiments described separately. There are, of course, other alternate embodiments which are obvious from the foregoing descriptions of the invention, which are intended to be included within the scope of the invention, as defined by the following claims.

I claim:

1. A hitting training apparatus comprising:

a. a structural base;

b. a vertical member extending upward from the structural base;

c. a horizontal carriage having a horizontal carriage weight;

d. a ball flexibly attached to the horizontal carriage by an arm;

e. a force balancing member arranged and configured to counteract the horizontal carriage weight;

f. an intermediate carriage connecting the horizontal carriage to the vertical member and g. a handle attached to the horizontal carriage;

h. wherein the intermediate carriage is arranged and configured to travel vertically along the vertical member and i. wherein the horizontal carriage is arranged and configured to travel horizontally along the intermediate carriage.

2. The hitting training apparatus of claim 1 wherein the arm is at least 10inches long.

3. The hitting training apparatus of claim 1 wherein the arm has an arm length, the ball is separated from the handle by a ball-handle separation distance and the ball-handle separation distance is at least twice the arm length.

4. The hitting training apparatus of claim 1 further comprising a sensor configured to identify characteristics of a bat striking the ball.

5. The hitting training apparatus of claim 1 wherein the structural base is at least 26 inches wide.

6. The hitting training apparatus of claim 1 wherein the ball is pivotally attached to the horizontal carriage.

7. The hitting training apparatus of claim 1 wherein the force balancing member is a spring.

8. The hitting training apparatus of claim 1 wherein the force balancing member is a counterbalance weight.

9. The hitting training apparatus of claim 1 further comprising an impact pad configured to absorb energy from impact by the ball.

10. The hitting training apparatus of claim 1 further comprising wheels.

11. The hitting training apparatus of claim 1 wherein the ball is located in a first position and wherein the ball is arranged and configured to return to the first position after being struck by a bat.

12. The hitting training apparatus of claim 1 wherein a force necessary to raise the horizontal carriage is less than the horizontal carriage weight.

13. The hitting training apparatus of claim 1 wherein the horizontal carriage has a horizontal carriage range of horizontal motion of at least fourteen inches and wherein the horizontal carriage has a horizontal carriage range of vertical motion of at least sixteen inches.

* * * * *